US008439222B2

(12) United States Patent
McClung et al.

(10) Patent No.: US 8,439,222 B2
(45) Date of Patent: May 14, 2013

(54) CONTAINER, AND SELECTIVELY FORMED CUP

(75) Inventors: James A. McClung, Canton, OH (US); Paul L. Ripple, Canton, OH (US); David Groetsch, Wexford, PA (US)

(73) Assignee: Stolle Machinery Company, LLC, Centennial, CO (US)

( * ) Notice: Subject to any disclaimer, the term of this patent is extended or adjusted under 35 U.S.C. 154(b) by 249 days.

(21) Appl. No.: 12/902,202

(22) Filed: Oct. 12, 2010

(65) Prior Publication Data

US 2011/0089182 A1 Apr. 21, 2011

Related U.S. Application Data

(60) Provisional application No. 61/253,633, filed on Oct. 21, 2009.

(51) Int. Cl.
*B65D 1/12* (2006.01)
*B65D 1/26* (2006.01)

(52) U.S. Cl.
USPC ..... 220/608; 220/609

(58) Field of Classification Search ..... 220/608, 220/609
See application file for complete search history.

(56) References Cited

U.S. PATENT DOCUMENTS 3,979,009 A * 9/1976 Walker ..... 220/609
4,020,670 A 5/1977 Bulso, Jr. et al.
4,214,471 A 7/1980 Bulso, Jr. et al.
4,248,076 A 2/1981 Bulso, Jr. et al.
4,341,321 A * 7/1982 Gombas ..... 220/606
4,343,173 A 8/1982 Bulso, Jr. et al.
4,372,143 A 2/1983 Elert et al.
4,416,140 A 11/1983 Bulso, Jr. et al.
4,454,743 A 6/1984 Bulso, Jr. et al.
4,483,172 A 11/1984 Bulso, Jr. et al.
4,535,618 A 8/1985 Bulso, Jr. et al.
4,696,177 A 9/1987 Bulso, Jr. et al.
4,732,031 A 3/1988 Bulso, Jr. et al.
4,800,743 A 1/1989 Bulso, Jr. et al.
4,826,382 A 5/1989 Bulso, Jr. et al.
5,024,077 A 6/1991 Bulso, Jr. et al.
5,218,849 A 6/1993 Sieger et al.
5,394,727 A 3/1995 Diekhoff et al.
5,622,070 A 4/1997 Bulso, Jr.
5,881,593 A 3/1999 Bulso, Jr. et al.
7,124,613 B1 10/2006 McClung
2009/0026214 A1 1/2009 Yuan et al.

* cited by examiner

*Primary Examiner* — Harry Grosso
(74) *Attorney, Agent, or Firm* — Eckert Seamans Cherin & Mellott, LLC; Grant E. Coffield

(57) ABSTRACT

A container, such as a beverage or food can is provided, which includes a first sidewall, a second sidewall and a bottom portion extending between the first and second sidewalls. The material of the bottom portion is stretched relative to the first sidewall and the second sidewall to form a thinned preselected profile, such as a dome. The material of the container at or about the dome has a substantially uniform thickness. The container is formed from a blank of material, which has a base gauge prior to being formed. After being formed, the material of the container at or about the dome has a thickness less than the base gauge. Tooling and a method for selectively forming a blank of material into a container, are also disclosed.

7 Claims, 11 Drawing Sheets

300

FORMING STAGES
(WITH STEP BEAD)

FORMING STAGES
(WITHOUT STEPS BEAD)

CONTAINER, AND SELECTIVELY FORMED CUP

RELATED APPLICATION

This application claims the benefit of Provisional Application No. 61/253,633, filed on Oct. 21, 2009 and entitled, "CONTAINER, AND SELECTIVELY FORMED CUP, TOOLING AND ASSOCIATED METHOD FOR PROVIDING SAME."

BACKGROUND

1. Field

The disclosed concept relates generally to containers and, more particularly, to metal containers such as, for example, beer or beverage cans, as well as food cans. The disclosed concept also relates to cups and blanks for forming cups and containers. The disclosed concept further relates to methods and tooling for selectively forming a cup or bottom portion of a container to reduce the amount of material in the cup or bottom portion.

2. Background Information

It is generally well known to draw and iron a sheet metal blank to make a thin walled container or can body for packaging beverages (e.g., carbonated beverages; non-carbonated beverages), food or other substances. Typically, one of the initial steps in forming such containers is to form a cup. The cup is generally shorter and wider than the finished container. Accordingly, the cups are typically subjected to a variety of additional processes that further form the cup into the finished container. As shown, for example, in FIG. 1, a conventional can body 2 has thinned sidewalls 4,6 and a bottom profile 8, which includes an outwardly protruding annular ridge 10. The bottom profile 8 slopes inwardly from the annular ridge 10 to form an inwardly projecting dome portion 12. The can body 2 is formed from a blank of material 14 (e.g., without limitation, sheet metal).

There is a constant desire in the industry to reduce the gauge, and thus the amount, of material used to form such containers. However, among other disadvantages associated with the formation of containers from relatively thin gauge material, is the tendency of the container to wrinkle, particularly during redrawing and doming. Prior proposals have, in large part, focused on forming bottom profiles of various shapes that were intended to be strong and, therefore, capable of resisting buckling while enabling metal having a thinner base gauge to be used to make the can body. Thus, the conventional desire has been to maintain the material thickness in the dome and bottom profile to maintain or increase strength in this area of the can body and thereby avoid wrinkling.

Tooling for forming domed cups or can bodies has conventionally included a curved, convex punch core and a concave die core, such that a domed can body is formed from material (e.g., without limitation, a sheet metal blank) conveyed between the punch core and the die core. Typically, the punch core extends downwardly into the die core, forming the domed cup or can body. In order to maintain the thickness of the domed portion, the material is relatively lightly clamped on either side of the portion to be domed. That is, the material can move (e.g., slide) or flow toward the dome as it is formed in order to maintain the desired thickness in the bottom profile. Doming methods and apparatus are disclosed, for example and without limitation, in U.S. Pat. Nos. 4,685,322; 4,723,433; 5,024,077; 5,154,075; 5,394,727; 5,881,593; 6,070,447; and 7,124,613, which are hereby incorporated herein by reference.

There is, therefore, room for improvement in containers such as beer/beverage cans and food cans, as well as in selectively formed cups and tooling and methods for providing such cups and containers.

SUMMARY

These needs and others are met by embodiments of the disclosed concept, which provide metal containers, such as beverage and food cans, cups and blanks for forming cups and containers, and methods and tooling for selectively forming a cup or bottom portion of a container to reduce the amount of material in the cup or bottom portion.

As one aspect of the disclosed concept, a container comprises: a first sidewall; a second sidewall; and a bottom portion extending between the first sidewall and the second sidewall. The material of the bottom portion is stretched relative to the first sidewall and the second sidewall to form a thinned preselected profile.

The thinned preselected profile may be a dome. The material of the container at or about the dome may have a substantially uniform thickness. The container may be formed from a blank of material, wherein the blank of material has a base gauge prior to being formed. After being formed, the material of the container at or about the dome may have a thickness less than the base gauge. The thickness of the material at or about the dome may be about 0.0003 inch to about 0.003 inch thinner than the base gauge.

The container may be formed from a blank of material, wherein the blank of material has a preformed dome portion.

As another aspect of the disclosed concept, tooling is provided for selectively forming a blank of material into a container. The container includes a first sidewall, a second sidewall, and a bottom portion extending between the first sidewall and the second sidewall. The tooling comprises: an upper tooling assembly; and a lower tooling assembly. The blank of material is clamped between the upper tooling assembly and the lower tooling assembly, proximate to the first sidewall and proximate to the second sidewall. The bottom portion is stretched relative to the first sidewall and the second sidewall to form a thinned preselected profile.

As a further aspect of the disclosed concept, a method for selectively forming a container is provided. The method comprises: introducing a blank of material to tooling; forming the blank of material to include a first sidewall, a second sidewall and a bottom portion extending between the first sidewall and the second sidewall; clamping the material between the tooling proximate to the first sidewall and proximate to the second sidewall to resist movement of the material; and stretching the bottom portion to form a thinned preselected profile.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
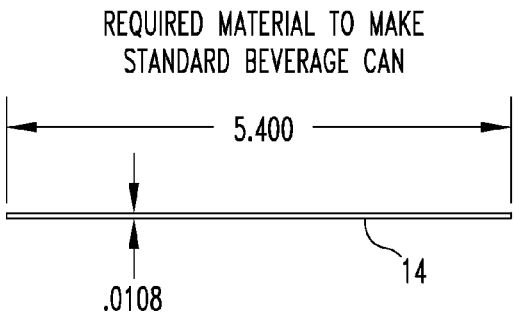
FIG.1 PRIOR ART
FIG. 1 is a side elevation view of a beverage can and a blank of material used to form the beverage can.
Figure 1:
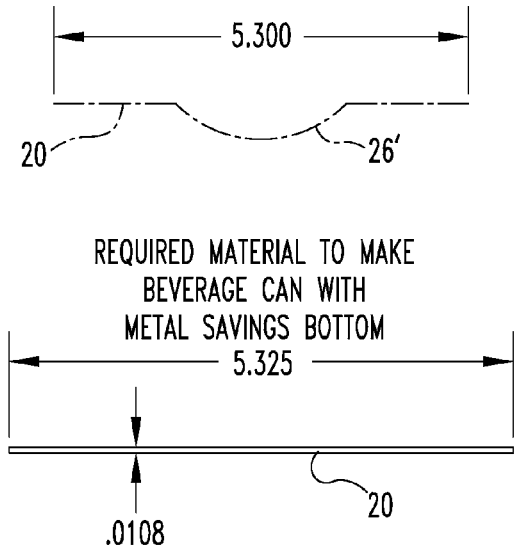
FIG.1 PRIOR ART
Figure 1:
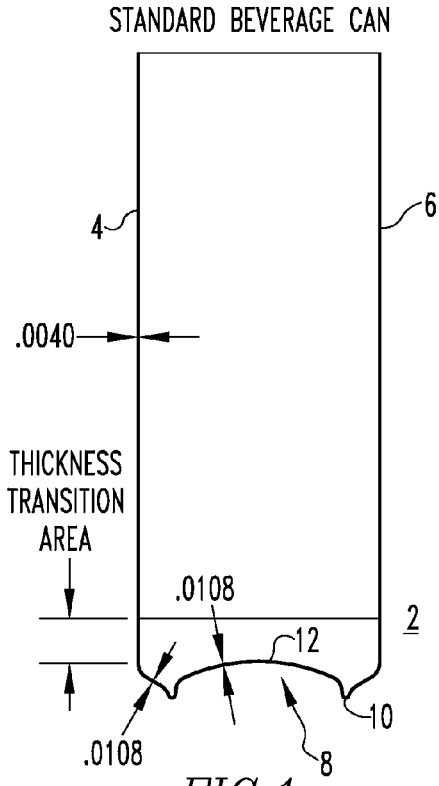
FIG.1 PRIOR ART

For purposes of illustration, embodiments of the disclosed concept will be described as applied to cups, although it will become apparent that they could also be employed to suitably stretch the end panel or bottom portion of any known or suitable can body or container (e.g., without limitation, beverage/beer cans; food cans).

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations and other physical characteristics related to the embodiments disclosed herein are not to be considered limiting on the scope of the disclosed concept.

Directional phrases used herein, such as, for example, left, right, front, back, top, bottom, upper, lower and derivatives thereof, relate to the orientation of the elements shown in the drawings and are not limiting upon the claims unless expressly recited therein.

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figure 2:
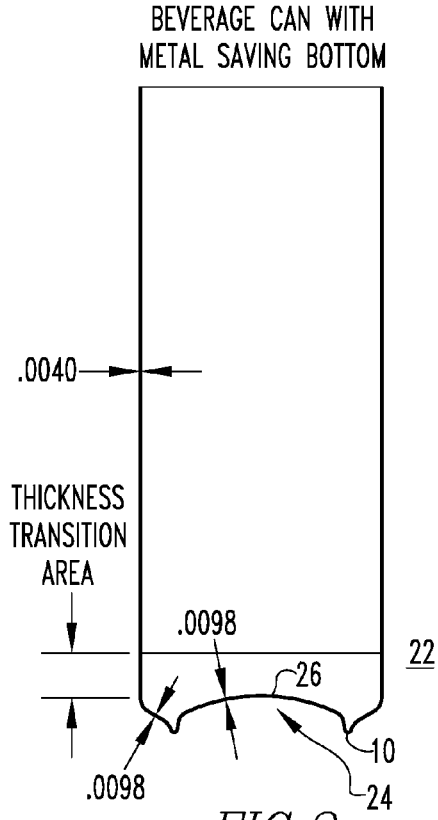
FIG. 2 is a side elevation view of one non-limiting example of a container and a blank of from which the container is formed in accordance with an embodiment of the disclosed concept, also showing, in phantom line drawing, a preformed blank of material in accordance with another aspect of the disclosed concept.

FIG. 2 shows a blank of material 20 and a beverage can 22 having a selectively formed bottom profile 24 in accordance with one non-limiting example of in accordance with the disclosed concept. Specifically, as described in detail hereinbelow, the material in the can bottom 24 and, in particular the domed portion 26 thereof, has been stretched, thereby thinning it. Although the example of FIG. 2 shows a beverage can, it will be appreciated that the disclosed concept can be employed to stretch and thin the bottom portion of any known or suitable alternative type of container (e.g., without limitation, food can (not shown)), or cup (see, for example, cup 122 of FIGS. 9A-9D and 11A-11D, and cup 222 of FIGS. 10A-10C), which is subsequently further formed into such a container.

It will also be appreciated that the particular dimensions shown in FIG. 2 (and all of the figures provided herein) are provided solely for purposes of illustration and are not limiting on the scope of the disclosed concept. That is, any known or alternative thinning of the base gauge could be implemented for any known or suitable container, end panel, or cup, without departing from the scope of the disclosed concept. In the non-limiting example of FIG. 2, the can body 22 has a wall thickness of 0.0040 inch and a substantially uniform thickness in the can bottom 24 and dome 26 of 0.0098 inch. Thus, the material in the can bottom 24 has been thinned by about 0.0010 inch from the base gauge of the blank of material 20 of 0.0108 inch. It will be appreciated that this is a substantial reduction, which results in significant weight reduction and cost savings over conventional cans (see, for example, the can body 2 of FIG. 1 having a can bottom 8 thickness of 0.0108 inch). Additionally, among other advantages, this enables a smaller blank of material to be used to form the same can body. For example and without limitation, the blank 20 in the non-limiting example of FIG. 2 has a diameter of about 5.325 inches, whereas the blank 14 of FIG. 1 has a diameter of about 5.400 inches. This, in turn, enables a shorter coil width (not shown) of material to be employed (i.e., supplied to the tooling), resulting in less shipping cost.

Moreover, the disclosed concept achieves material thinning and an associated reduction in the overall amount and weight of material, without incurring increased material processing charges associated with the stock material that is supplied to form the end product. For example and without limitation, increased processing (e.g., rolling) of the stock material to reduce the base gauge (i.e., thickness) of the material can undesirably result in a relatively substantial increase in initial cost of the material. The disclosed concept achieves desired thinning and reduction, yet uses stock material having a more conventional and, therefore, less expensive base gauge.

Continuing to refer to FIG. 2, it will be appreciated that the disclosed concept could employ, or be implemented to be employed with, preformed blanks of material 20'. For example and without limitation, a preformed blank of material 20' having a preformed dome portion 26' is shown in phantom line drawing in FIG. 2. Such a preformed blank 20' could be fed to the tooling 300 (FIG. 3), 300' (FIGS. 4-8) and subsequently further formed into the desired cup 122 (FIGS. 9A-9D and 11A-11D), 222 (FIGS. 10A-10C) or container 22 (FIG. 1). One advantage of such a preformed blank of material 20', is the ability of a plurality of such blanks 20' to nest, one within another, for purposes of transporting and shipping the blanks 20'. The preformed dome portion 26' also provides a mechanism to grab and orient the blank 20' within the tooling 300 (FIG. 3), 300' (FIGS. 4-8), as desired. Furthermore, it also enables the width of the blank 20' to be still further reduced. For example and without limitation, in the non-limiting example of FIG. 2, the preformed blank 20' has a reduced diameter of 5.300 inches.

FIGS. 3-8 show various tooling 300 (FIG. 3), 300' (FIGS. 4-8) for stretching and thinning the container material (e.g., without limitation, blank; cup; can body), in accordance with the disclosed concept. Specifically, the selective forming (e.g., stretching) is accomplished by way of precise tooling geometry and placement. In accordance with one non-limiting embodiment, the process begins by introducing a blank of material (e.g., without limitation, blank 20) between components of a tooling assembly 300 (FIG. 3), 300' (FIGS. 4-8), and forming a standard flat bottom cup 122 (see, for example, FIGS. 9A and 10A) with base metal thickness or gauge.

Figure 3:
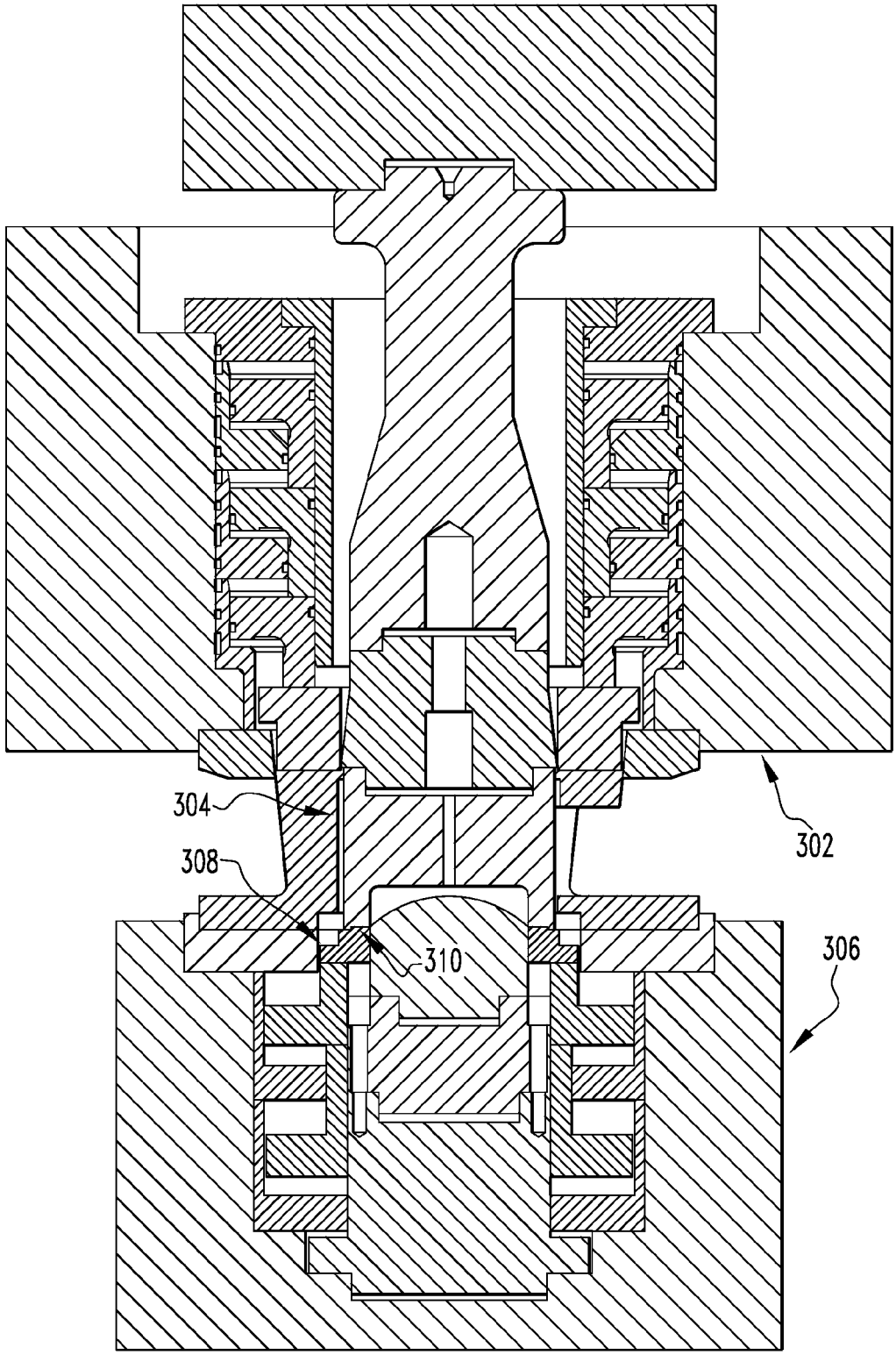
FIG. 3 is a side elevation section view of tooling in accordance with an embodiment of the disclosed concept.
Figure 4:
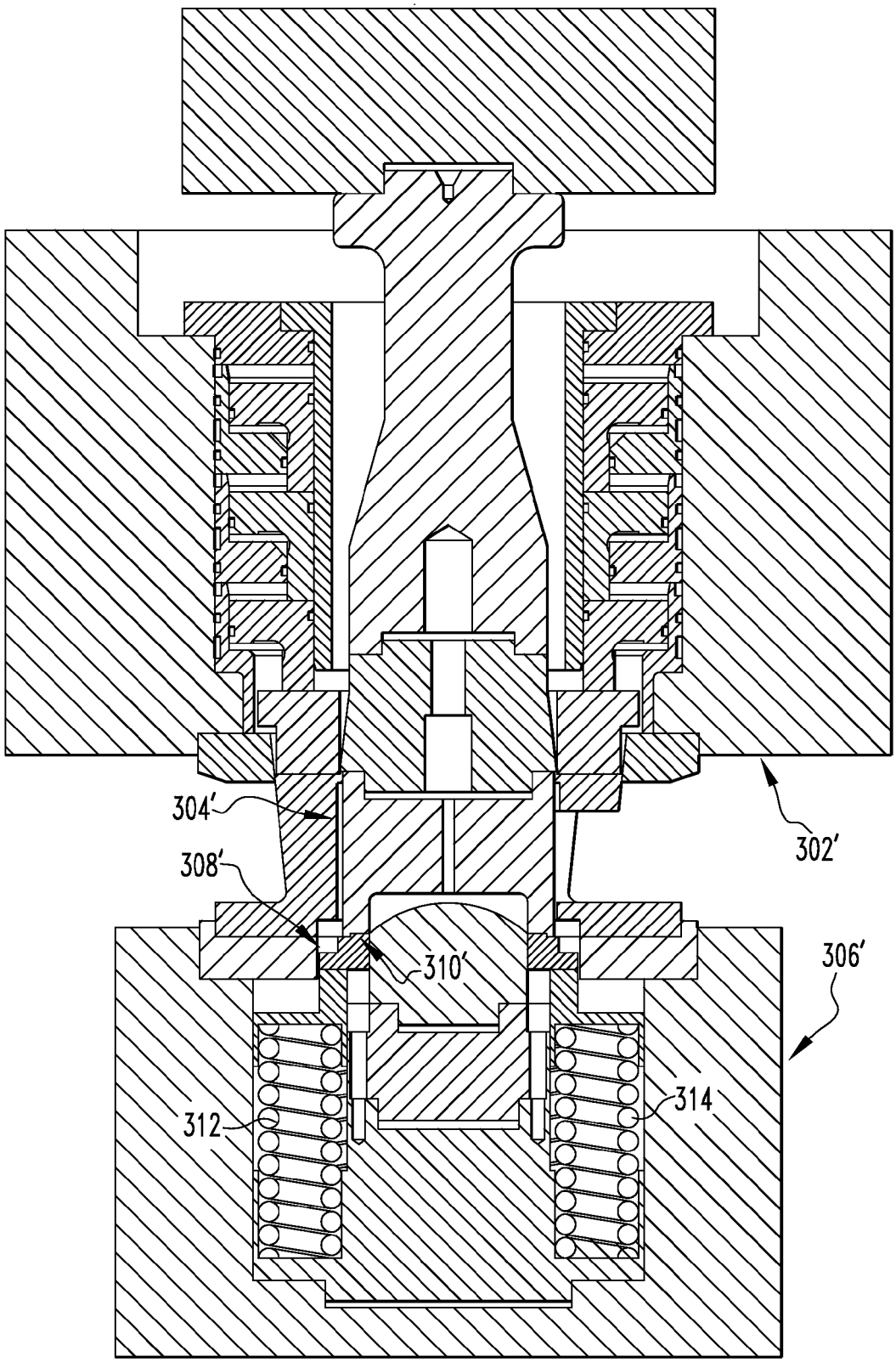
FIG. 4 is a side elevation section view of tooling in accordance with another embodiment of the disclosed concept.
Figure 5:
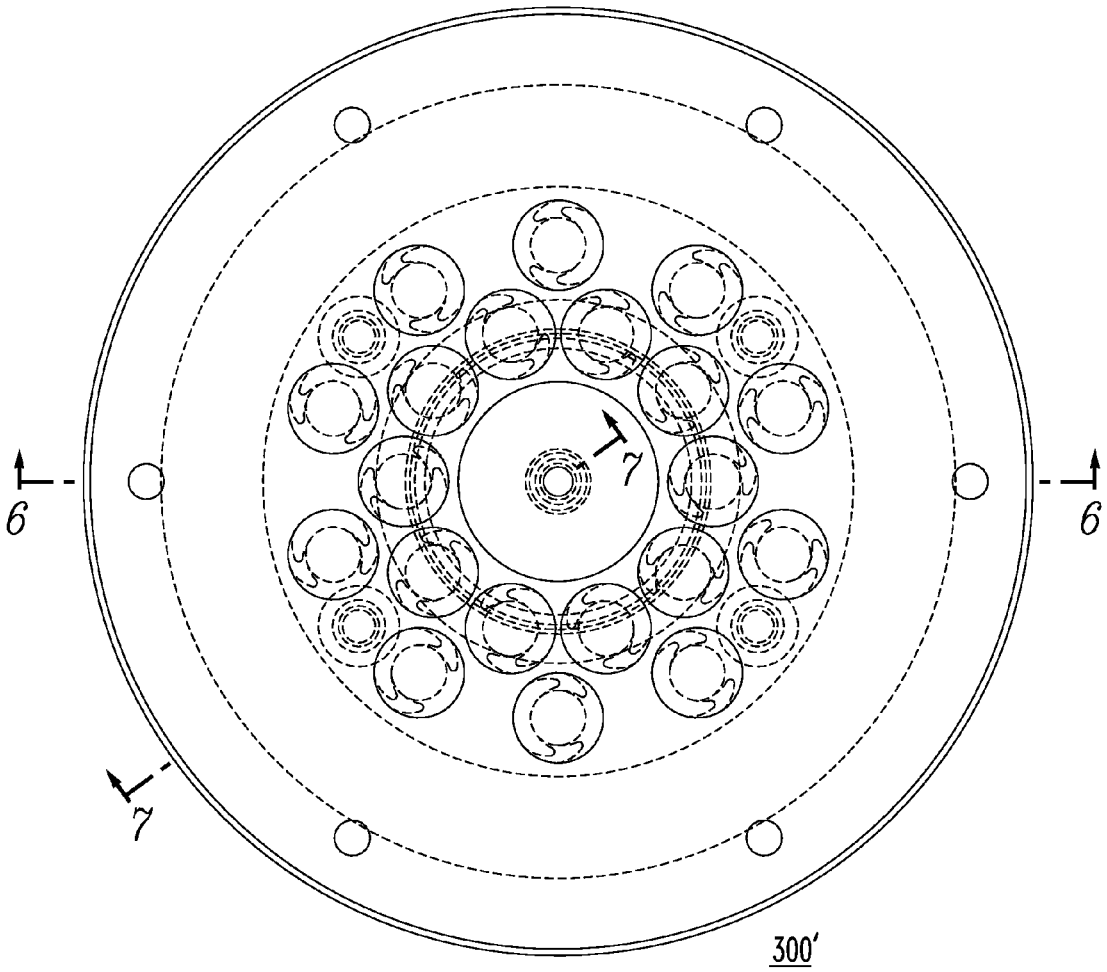
FIG. 5 is a top plan view of a portion of the tooling of FIG. 4.
Figure 6:
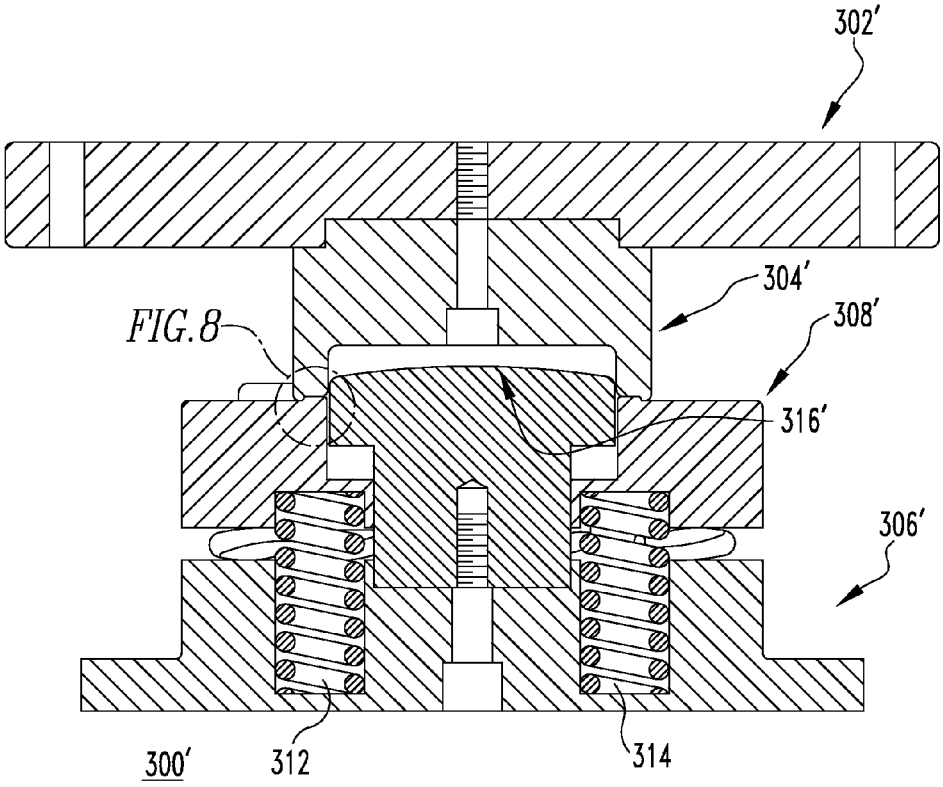
FIG. 6 is a section view taken along line 6-6 of FIG. 5.
Figure 7:
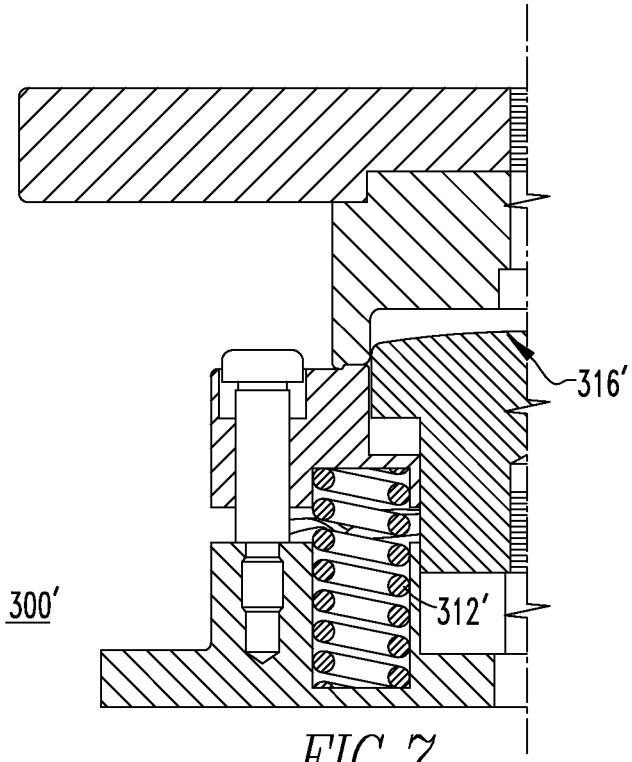
FIG. 7 is a section view taken along line 7-7 of FIG. 5.
Figure 8:
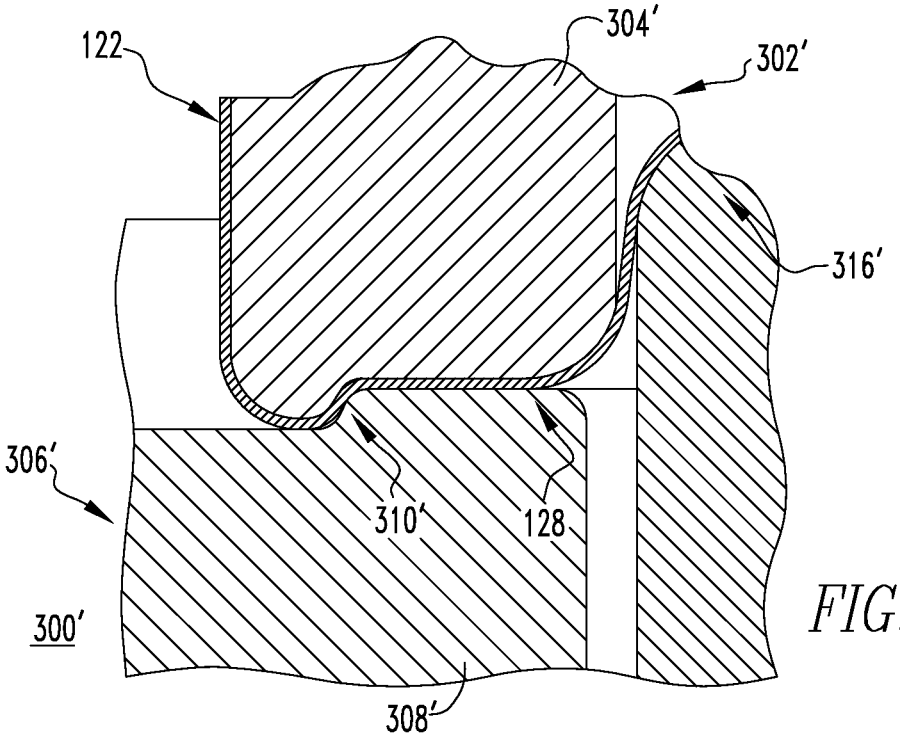
FIG. 8 is an enlarged view of segment 8 of FIG. 6.

As shown in FIGS. 3 and 4, the tooling preferably includes a forming punch 304 (FIG. 3), 304' (FIG. 4), and a lower tool assembly 306 (FIG. 3), 306' (FIG. 4). After the cup 122 is formed, the forming punch 304 continues moving downward, pushing the cup 122 lower until the cup 122 contacts a lower pad 308,308'. In the non-limiting embodiment shown and described herein, the lower pad 308 has a contoured step bead 310 (best shown in the enlarged view of FIG. 8 as step bead 310' in lower pad 308'), although it will be appreciated that such a step bead is not required. The contoured step bead 310,310' facilitates holding the material substantially stationary, for example, by crimping it and locking the material just inboard of the cup sidewall 124, as shown in FIG. 8. In this manner, the material in the sidewall 124 is held securely, preventing it from sliding or flowing into the bottom portion 128 of the cup 122. Accordingly, it will be appreciated that the disclosed concept differs substantially from conventional container bottom forming (e.g., without limitation, doming) methods and apparatus. That is, while the side portions of the cup or container in a traditional forming process might be clamped, relatively little pressure is applied so that movement (e.g., sliding; flowing) of the material into the bottom portion of the cup or container is promoted. In other words, traditionally clamping and stretching the material in the bottom portion of the container was expressly avoided, so as to maintain the thickness of the material in the bottom portion.

It will be appreciated that the aforementioned step bead 310,310' is not a required aspect of the disclosed concept. For example, FIGS. 9A-9D illustrate the consecutive steps or stages of forming a non-limiting example cup 122 in accordance with an embodiment of the disclosed concept wherein the tooling 300,300' includes the step bead 310,310', whereas FIGS. 10A-10C illustrate the consecutive forming stages of a cup 222 in accordance with another embodiment of the disclosed concept wherein the tooling does not include any step bead. It will be appreciated that while four forming stages are shown in FIGS. 9A-9D and three forming stages are shown in the example of FIGS. 10A-10C, that any known or suitable alternative number and/or order of forming stages could be performed to suitably stretch and thin material in accordance with the disclosed concept. It will further be appreciated that any known or suitable mechanism for sufficiently securing the material to resist movement (e.g., sliding) or flow of the material into the bottom portion 128 (e.g., dome 130) could be employed, without departing from the scope of the disclosed concept. For example and without limitation, pressure to secure the sides 124,126 of the cup 122 or container body 22 (FIG. 2), or locations proximate thereto, can be provided pneumatically, as generally shown in FIG. 3, or by a predetermined number of biasing elements (e.g., without limitation, springs 312,314), as shown in FIGS. 4-7, or by any other know or suitable holding means (e.g., without limitation, hydraulic force) or mechanism (not shown).

In accordance with one non-limiting embodiment of the disclosed concept, it will be appreciated that although the material is clamped (e.g., secured in a substantially fixed position) so as not to permit it to move (e.g., slide) or flow, and to instead be stretched in a subsequent forming step, the amount of force (e.g., pressure) that is necessary to apply such a clamping effect, is preferably minimized. In this manner, it is possible to provide the necessary clamping force to facilitate the disclosed stretching and thinning, without requiring a different press (e.g., without limitation, a press having greater capacity) (not shown). Accordingly, the disclosed concept can advantageously be readily employed with existing equipment in use in the field, by relatively quickly and easily retooling the existing press.

Table 1 quantifies the clamping force and deflection resulting from employing different numbers (e.g., 5; 10; 20) of springs (e.g., without limitation, springs 312,314) to apply the clamping force in accordance with several non-limiting example embodiments of the disclosed concept.

TABLE 1

| deflection (mm) | | load (kg) | deflection (in) | load (lbs) | ×5 springs | ×10 springs | ×20 springs |
|---|---|---|---|---|---|---|---|
| 4 | 6.2% | 60 | 0.16 | 132.2 | 661.2 | 1,322.4 | 2,644.8 |
| 10.4 | 16.0% | 156 | 0.41 | 343.8 | 1,719.1 | 3,438.2 | 6,876.5 |
| 11 | 16.9% | 176 | 0.43 | 387.9 | 1,939.5 | 3,879.0 | 7,758.1 |
| 13 | 20.0% | 195 | 0.51 | 429.8 | 2,148.9 | 4,297.8 | 8,595.6 |

Once the peripheral material is suitably clamped (e.g., secured in a substantially fixed in position, as shown for example and without limitation in FIG. 8), the punch 304' continues to move downward, forcing the material in the cup bottom area 128 to be forced into the contour 316 (FIGS. 6-8) of the tools 300' causing the material to stretch into the contoured shape 130 (FIGS. 9D, 10C, 11A-11D, 12 and 13), thereby thinning the material. A non-limiting example of a cup 122 which has been formed in accordance with this process is shown in FIGS. 9A-9D (tooling 300' includes step bead 310'). Another example cup 222 is shown in FIGS. 10A-10C (tooling does not include step bead). It will be appreciated, for example with reference to FIG. 9D, that the material in the dome portion 130 (FIGS. 9D and 11D), 230 (FIG. 106) can be stretched and, therefore, thinned by up to about 0.001 inch, or more. It will also be appreciated that while the contoured shape in the example shown and described herein is a dome 130,230, that any other known or suitable alternative shapes could be formed without departing from the scope of the disclosed concept.

Figure 9A:
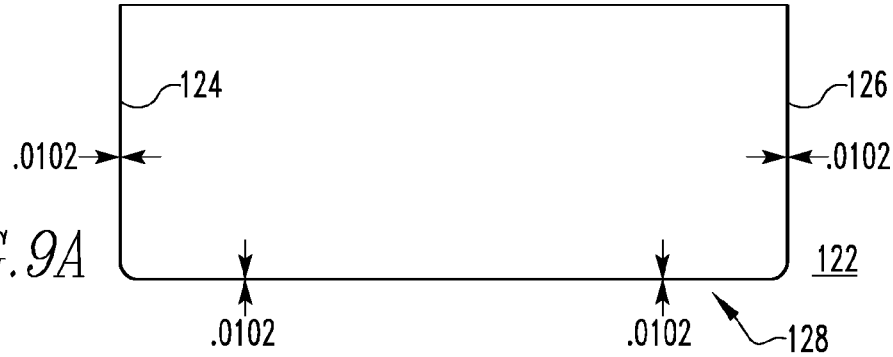
FIGS. 9A-9D are side elevation views of consecutive forming stages of a cup, in accordance with a non-limiting example embodiment of the disclosed concept.
Figure 9B:
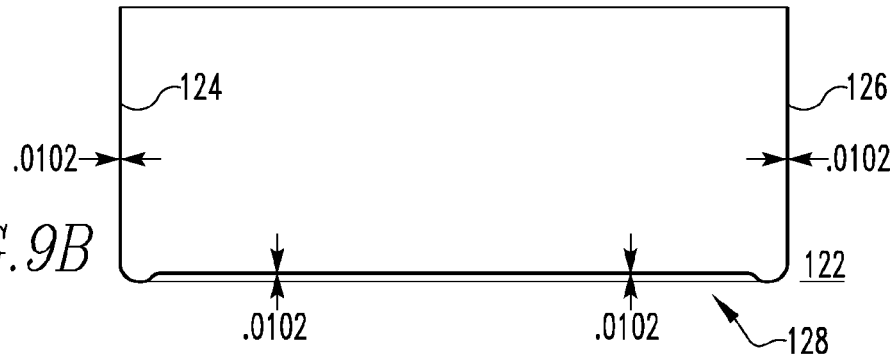
Figure 9C:
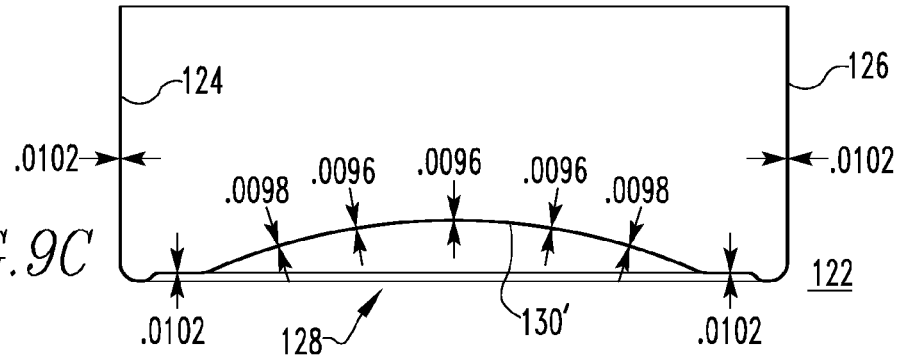
Figure 9D:
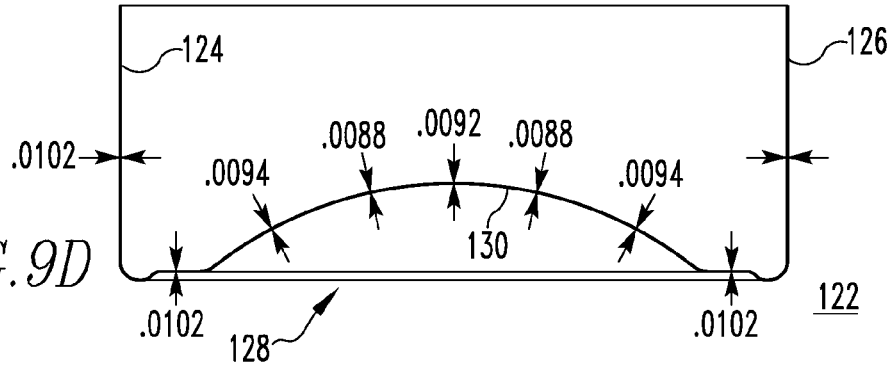
Figure 10A:
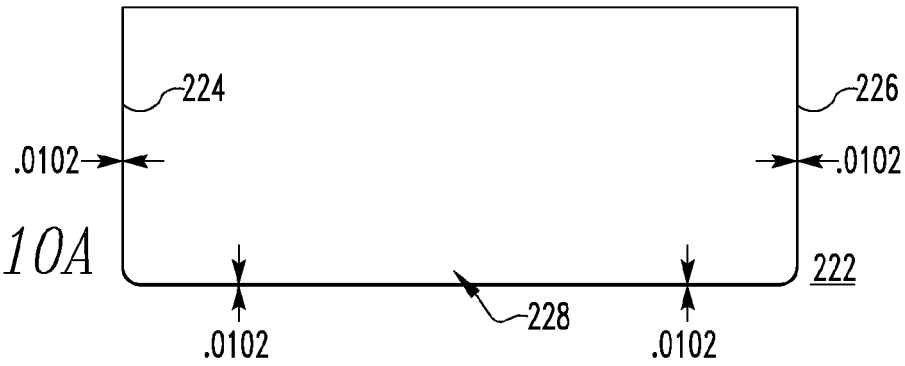
FIGS. 10A-10C are side elevation views of consecutive forming stages of a cup, in accordance with another non-limiting example embodiment of the disclosed concept.
Figure 10B:
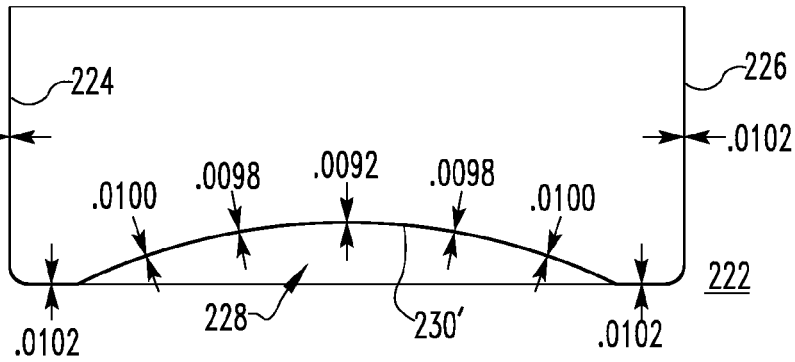
Figure 10C:
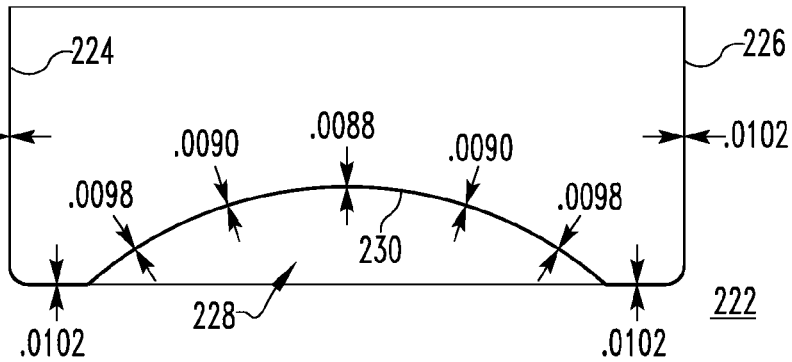
Figure 11A:
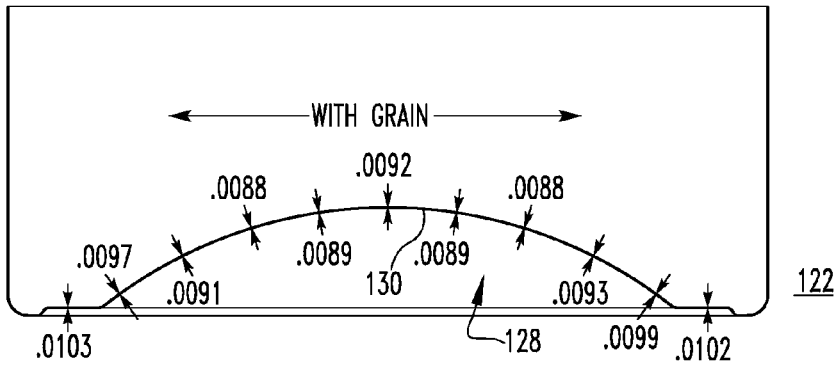
FIGS. 11A-11D are side elevation views showing the metal thickness of the cup thinned in accordance with a non-limiting example embodiment of the disclosed concept, respectively showing the substantial uniform thickness of the dome in a direction with the grain of the material, in a direction against the grain, in a direction at 45 degrees with respect to the grain, and in a direction 135 degrees with respect to the grain.
Figure 11B:
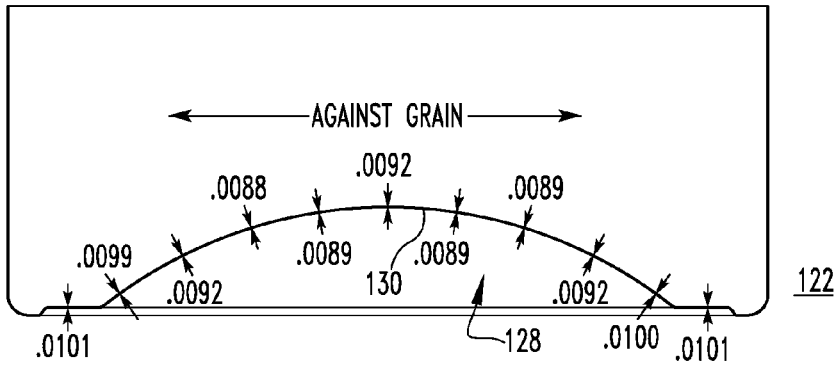
Figure 11C:
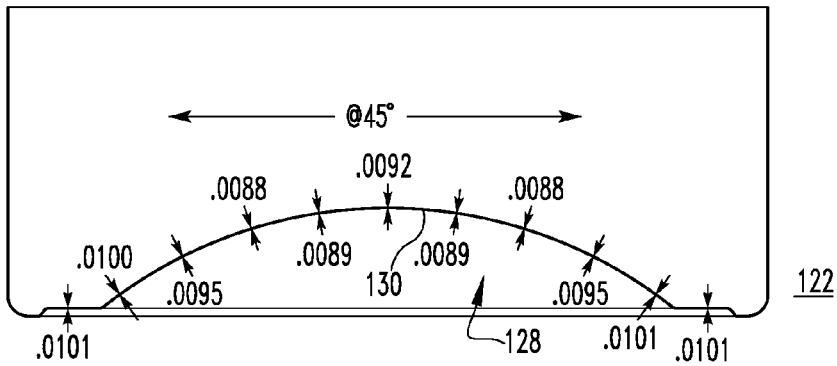
Figure 11D:
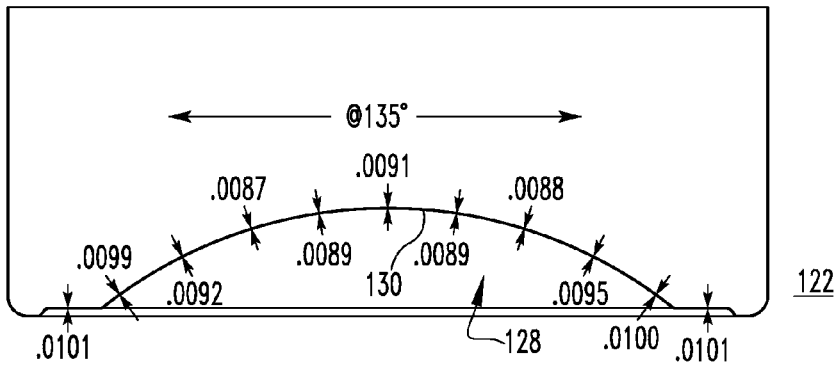
Figure 12:
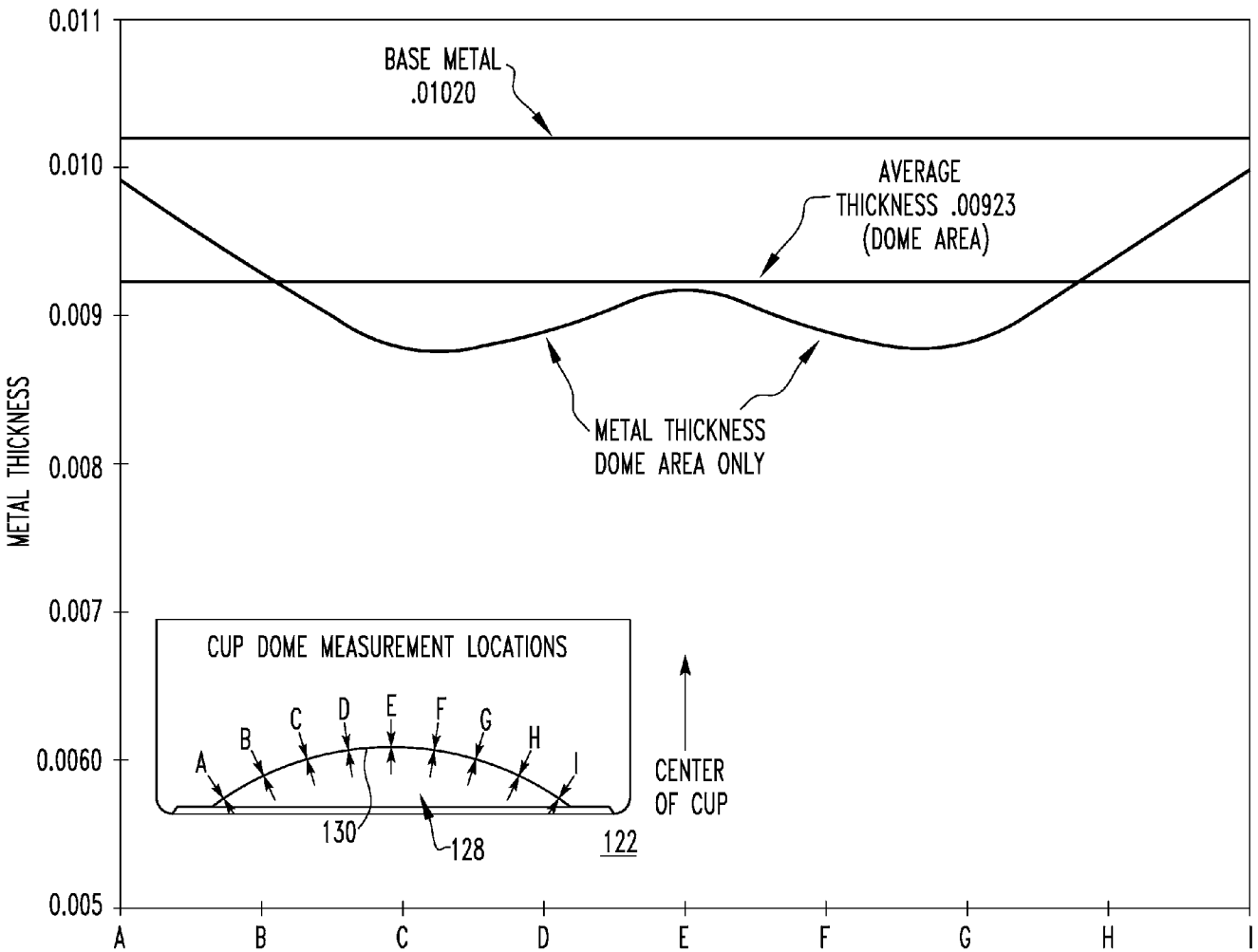
FIG. 12 is a graph plotting the metal thickness of the dome at various locations of the dome, in accordance with a non-limiting example embodiment of the disclosed concept.
Figure 13:
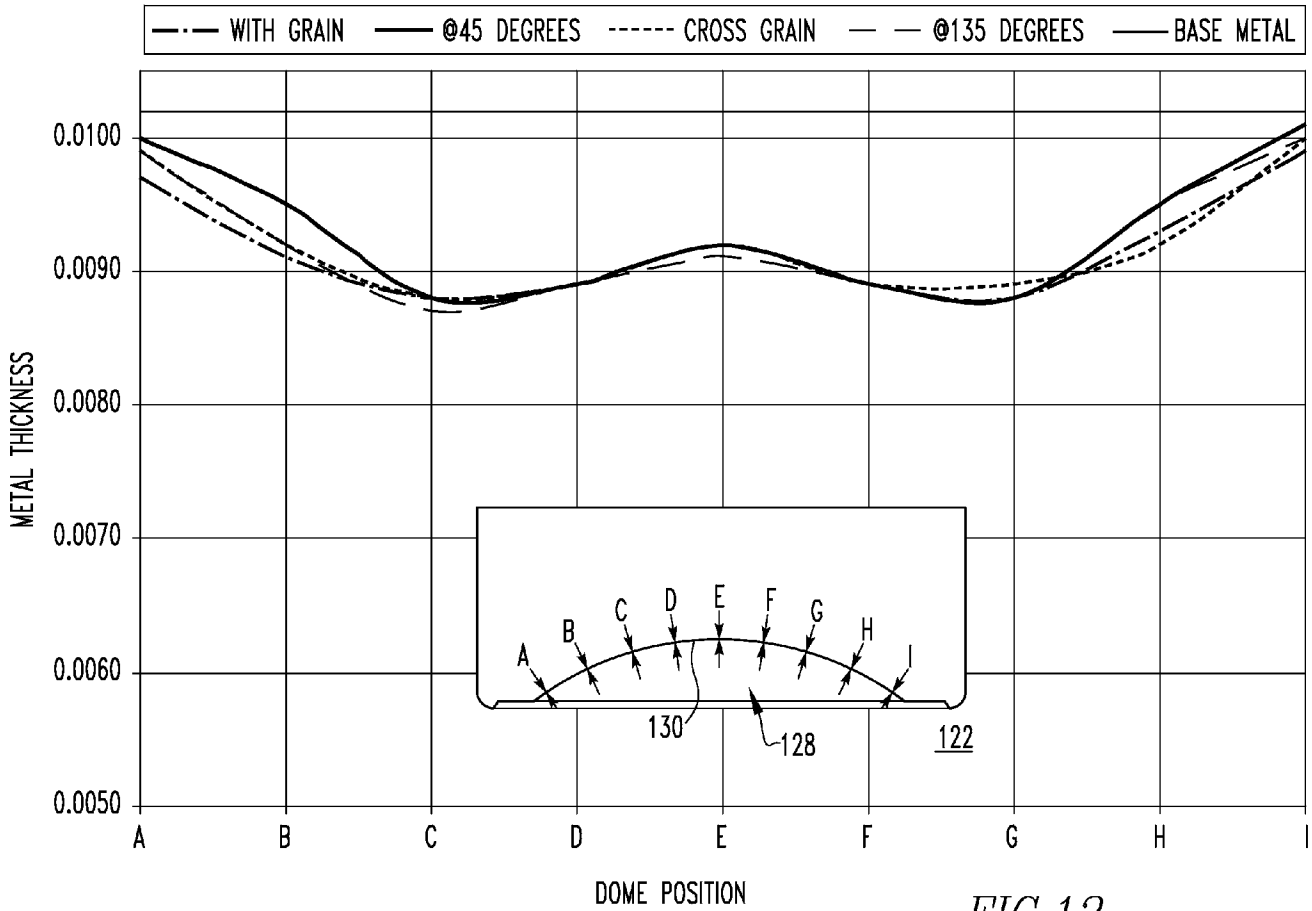
FIG. 13 is a graph plotting the metal thickness of the base metal and of the dome at the various locations of the dome of FIG. 12, for each of the directions of FIGS. 11A-11D, as well as in the cross grain direction.

Referring to FIGS. 9C, 9D, 11A-11D, 12 and 13, it will be appreciated that the stretched material of the dome portion 130 is also advantageously substantially uniform in thickness. More specifically, the material is uniform in thickness not only for various locations (see, for example, measurement locations A-I of FIGS. 12 and 13) along the width or diameter of the dome 130, as shown in FIGS. 9C (partially formed cup dome 130') and 9D (completely formed cup dome 130), but also in various directions, such as with the grain as shown in FIGS. 11A and 13, against the grain as shown in FIGS. 11B and 13, at 45 degrees with respect to the grain as shown in FIGS. 11C and 13, and at 135 degrees with respect to the grain, as shown in FIGS. 11D and 13. The graphs of FIGS. 12 and 13 further confirm these findings. FIG. 13 shows, in one graph, a plot of the metal thicknesses at locations A-I for each of the foregoing directions with respect to the grain, as well as in the cross grain direction.

Accordingly, it will be appreciated that the disclosed concept provides tooling 300 (FIG. 3), 300' (FIGS. 4-8) and methods for selectively stretching and thinning the bottom portion 24 (FIG. 2), 128 (FIGS. 9A-9D and 11A-11D), 228 (FIGS. 10A-10C) of a container 22 (FIG. 2) or cup 122 (FIGS. 9A-9D and 11A-11D), 222 FIGS. 10A-10C), such as a domed portion 26 (FIG. 2), 130 (FIGS. 9D and 11A-11D), 230 (FIG. 10C), thereby providing relatively substantially material and cost savings.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A container comprising:

a first sidewall;

a second sidewall; and a bottom portion extending between the first sidewall and the second sidewall, wherein the material of the bottom portion is stretched and thereby thinned relative to the first sidewall and the second sidewall to form a thinned preselected profile, and wherein the container is formed from a blank of material; and wherein the blank of material has a preformed dome portion.

2. The container of claim 1 wherein the thinned preselected profile is a dome.

3. The container of claim 2 wherein the material of the container at or about the dome has a substantially uniform thickness.

4. The container of claim 2 wherein the blank of material has a base gauge prior to being formed; wherein, after being formed, the material of the container at or about the dome has a thickness; and wherein the thickness of the material at or about the dome is less than the base gauge.

5. The container of claim 4 wherein the thickness of the material at or about the dome is about 0.0003 inch to about 0.003 inch thinner than the base gauge.

6. The container of claim 1 wherein the container is a can body.

7. The container of claim 1 wherein the container is a cup.

* * * * *

UNITED STATES PATENT AND TRADEMARK OFFICE

CERTIFICATE OF CORRECTION

PATENT NO. : 8,439,222 B2
APPLICATION NO. : 12/902202
DATED : May 14, 2013
INVENTOR(S) : James A. McClung et al.

It is certified that error appears in the above-identified patent and that said Letters Patent is hereby corrected as shown below:

In the drawings;
Figure 12, vertical axis, “0.0060” should read --0.006--.
In the specification;
Column 3, line 60, “example of in accordance” should read --example in accordance--.
Column 5, line 66, “know” should read --known--.
Column 6, line 43, “(FIG. 106)” should read --(FIG. 10C)--.
Column 7, line 6, “substantially” should read --substantial--.

Signed and Sealed this
Seventeenth Day of May, 2016

Michelle K. Lee

Michelle K. Lee
*Director of the United States Patent and Trademark Office*